US008155273B2

(12) United States Patent
Eaton et al.

(10) Patent No.: US 8,155,273 B2
(45) Date of Patent: Apr. 10, 2012

(54) FLAT PANEL X-RAY SOURCE

(75) Inventors: Mark F. Eaton, Austin, TX (US); Leonid D. Karpov, Cedar Park, TX (US)

(73) Assignee: Stellar Micro Devices, Austin, TX (US)

( * ) Notice: Subject to any disclaimer, the term of this patent is extended or adjusted under 35 U.S.C. 154(b) by 53 days.

(21) Appl. No.: 12/201,741

(22) Filed: Aug. 29, 2008

(65) Prior Publication Data

US 2009/0080614 A1 Mar. 26, 2009

Related U.S. Application Data

(63) Continuation of application No. 11/355,692, filed on Feb. 16, 2006, now abandoned.

(51) Int. Cl.
*H01J 35/06* (2006.01)

(52) U.S. Cl. ..... 378/136; 378/122; 378/130; 378/134

(58) Field of Classification Search ..... 378/63, 378/64, 119, 121, 122, 124, 134, 136, 140, 378/143; 313/309–311, 370, 446, 495, 496, 313/497; 250/504 R; 372/74
See application file for complete search history.

(56) References Cited

U.S. PATENT DOCUMENTS 4,789,997 A 12/1988 Madsen
5,191,517 A 3/1993 Stephenson
5,568,021 A 10/1996 Bederka et al.
6,333,968 B1 12/2001 Whitlock et al.
6,553,096 B1 * 4/2003 Zhou et al. ..... 378/122
6,607,930 B2 * 8/2003 Karpov et al. ..... 438/20
6,658,088 B2 * 12/2003 Tiren ..... 378/119
7,072,439 B2 7/2006 Radley et al.
7,274,136 B2 * 9/2007 DiSanto et al. ..... 313/495
7,300,634 B2 11/2007 Yaniv et al.
7,469,040 B2 * 12/2008 Holm et al. ..... 378/136
7,553,446 B1 * 6/2009 Treece et al. ..... 422/22
2006/0273710 A1 12/2006 Marking et al.

OTHER PUBLICATIONS

Williams et al. Lasar action in strongly scattering rare-earth-metal-doped dielectric nanophosphors, Phys. Rev. A65, pp. 013807-1-013807-6, (2001).

Nilsson et al. UV-Bremsstrahlung from Tungsten. Japanese Journal of Applied Physics, 1978, vol. 17, Supplement 17-2, pp. 144-146.

* cited by examiner

*Primary Examiner* — Allen C. Ho

(74) *Attorney, Agent, or Firm* — Hulsey, P.C.; William N. Hulsey, III; Loren T. Smith

(57) ABSTRACT

A radiation source which can emit X-ray flux using electron beam currents from a cathode array formed on the window through which the radiation will exit the source. The source can be made in formats which are compact or flat compared with prior art radiation sources. X-ray flux produced by the source can be used for such purposes as radiation imaging, sterilization, decontamination of biohazards or photolithography.

16 Claims, 7 Drawing Sheets

FLAT PANEL X-RAY SOURCE

CROSS-REFERENCE TO RELATED APPLICATIONS

This application is a continuation of and claims priority to U.S. application Ser. No. 11/355,692, by Mark F. Eaton, entitled "Compact Radiation Source", filed on Feb. 16, 2006 now abandoned, which is incorporated by reference, as if set forth in its entirety herein.

Parts of this invention were made with Government support under Contract No. FA9451-04-M-0075 awarded by the U.S. Air Force. The Government has certain rights in the invention.

FIELD

This disclosure relates in general to the field of radiation production and radiation sources. More particularly, the present disclosure relates to X-ray radiation.

BACKGROUND OF THE INVENTION

This invention provides a radiation source which can emit X-ray flux and other forms of radiation producible by an electron beam current. The substance of the invention is the formation of the cathode or cathode array which produces the electron beam current on the window through which the radiation will exit the source. The radiation source disclosed herein can be made in formats which are compact or flat as compared with prior art radiation sources. X-ray flux produced by the invention can be used for such purposes as radiation imaging, sterilization, decontamination of biohazards or photolithography.

Radiation has come to be used for many purposes. Since the discovery of X-radiation by Roentgen and others over 100 years ago, X-rays have found widespread use in medical, industrial and scientific imaging as well as in sterilization, lithography, medical radiation therapies and a variety of scientific instruments. X-rays are most commonly produced with vacuum X-rays tubes, the operation of which is shown conceptually in FIG. 1*a* and in diagram in FIG. 2. An electron beam source, traditionally a hot filament cathode, is biased at a high potential across a vacuum relative to a metal anode which serves as an X-ray target. Current from the cathode produces both characteristic line radiation and Bremsstrahlung radiation as it strikes the anode target. The target is commonly disposed at an angle to the electron beam current so as to direct the X-rays thus produced out a window, this window commonly being made of a material, such as beryllium, with a low atomic number (Z number). As a general matter, the higher the Z number of the target, and the higher the electrical potential and energy of the beam, the more X-radiation is produced. The lower the Z number of the window, the less radiation is absorbed by the window. Radiation which does not exit the window is absorbed elsewhere in the tube. X-ray flux may be collimated by limiting the flux which exits to tube to a small window. X-ray tubes commonly have low power efficiencies; typically only about 1% of the power used to produce the electron beam current is realized in the X-ray beam energy exiting the tube. The production of X-rays by the electron beam striking the target also generates a considerable amount of heat, since most of the beam energy is absorbed in the target. Numerous inventions have been made over the years to conduct this heat out of the tube, to improve the X-ray production efficiency of the target, or to rotate the anode so as to reduce pitting or melting of the target.

(J. Selman. The Fundamentals of X-Ray and Radium Physics, 8, ed. Thomas Books Springfield, Ill. 1994).

Recently, a number of inventions have been made in which the traditional hot filament cathode in an X-ray tube is replaced with a cold cathode operating on the principles of field emission. Field emission cold cathodes have a number of advantages over hot filament cathodes. They do not require a separate heater to generate an electron beam current, so they consume less power. They can be turned on and off instantly in comparison with filament cathodes. They can also be made very small, so as to be used in miniature X-ray sources for radiation therapy, for example. U.S. Pat. Nos. 5,854,822 and 6,477,233 disclose examples of miniature cold cathode X-ray tubes. U.S. Pat. Nos. 6,760,407 and 6,876,724 disclose examples of larger X-ray tubes using cold cathodes for other purposes, such as imaging. Several types of field emission cold cathodes have been developed which can be substituted for hot filament cathodes. These include arrays of semiconductor or metal microtips, flat cathodes of low work function materials and arrays of carbon or other nanotubes. While they offer several improvements, these cold cathode X-ray tubes share the limitations of their hot filament tube predecessors in being essentially point sources of X-rays. U.S. Pat. No. 6,333,968 discloses a transmission cathode for X-ray production in which current from the cathode generates X-rays on a target opposite the cathode, the radiation then transmitting through the cathode. The cathode covers substantially the entire exit area for the radiation. This limits the size of the radiation exit area to the size of the cathode, making this type of source essentially a point source of X-rays.

Other recent inventions have been made which use a wide area cold cathode or cold cathode array opposite a thin-film X-ray target disposed on an exit window. Examples are disclosed in U.S. Pat. Nos. 6,477,233 and 6,674,837. In these X-ray sources, the wide-area or pixelated beam of electrons produces a wide-area or pixelated source of X-rays. Electrons striking the X-ray target produce X-radiation in all directions. As shown conceptually in FIG. 1*b*, if the target is made thin enough, a portion of the X-rays will exit the side of the target opposite the electron beam source and pass through the exit window. A limitation of this type of X-ray source is that the heat produced in this process can be difficult to manage. The thinner the target film, the more X-ray flux can pass through the exit side, but the less heat can be dissipated by the film. The heat must ultimately be dissipated through the exit window or other parts of the vacuum envelope. In doing so, thermal stresses will be produced which necessarily limit the power of the X-rays that can be generated in this manner.

In addition to the traditional uses of X-ray radiation sources, new applications have arisen in response to the threat of bio-terrorism or chemical agent terrorism. Chemical and gas methods for the remediation of hazards such as anthrax, ricin, or smallpox suffer a number of limitations, including hazards to human operators during their application, lingering hazards after they have been applied, limited effectiveness, long set-up and application times and destruction of electronic and other equipment in the treatment area. X-rays destroy biological agents through ionization. They can break chemical bonds and thus remediate chemical hazards. They can decontaminate biohazards in a matter of minutes or hours, compared to days and weeks with chemical and gas methods. X-rays have the further advantage of being able to penetrate objects or surfaces which may occlude hazardous material. However, sources of X-ray are needed which are compact, power efficient and do not suffer the limitations of prior art methods.

OBJECTS AND ADVANTAGES OF THE INVENTION

The object of this invention is to provide a source of X-rays.

Another specific object of the invention is to provide an X-ray source which is flat and wide.

A further specific object of the invention is to provide an X-ray source which is long, thin and flat.

Another object of the invention is to provide an efficient source of X-ray flux generation by directing the electron beam current at the X-ray target at an advantageous angle.

Another object of the invention is to provide a wide-area, pixelated source of X-ray flux.

Another object of the invention is to provide a wide-area X-ray target so as to improve heat dissipation compared with small X-ray targets, thereby allowing operation of the radiation source at high power levels.

A further object of the invention is to thermally match the components of the source so as to provide long-term operation of the source without damaging mechanical stresses even at high power output levels.

Another object of the invention is to provide an electron beam source which can be used to pump powder laser phosphors.

An advantage of the invention is the generation of X-ray flux from a wider area than is possible with point sources and at higher energies than are possible with thin-film X-ray targets formed on the exit window. A specific advantage is that the invention can be used to make a flat, wide-area X-ray source that can enable more compact equipment for X-ray imaging, lithography or medical therapy than is the case with conventional X-ray tubes, which require a throw distance for the flux to cover a wide area. As a further specific advantage, the invention can be used to make X-ray sources which are long, thin and flat, thereby enabling the construction of more compact computed tomography apparatus.

Another advantage of the invention is the efficient generation of X-ray flux. This allows the construction of apparatus using X-ray flux to be more power efficient or more compact for a given level of rated power output.

A further advantage of the invention is improved heat dissipation from the wide X-ray target, which can be made of a sheet or slab of metal with the other side from the target exposed to atmosphere or connected to a heat sinking structure exposed to atmosphere. Improved heat dissipation means that the source can generate more X-ray flux for longer periods of time, which is useful in applications such as biohazard decontamination. The radiation source built according to the invention will also require less cooling than conventional sources. For example, forced air cooling can be used for radiation sources built according to the invention at power output levels which would require water cooling in conventional sources.

Another advantage of the invention is that it can be used as a wide, pixelated source of X-ray flux. This pixelated X-ray flux source may be used in conjunction with pixelated X-ray detectors to construct a compact radiation imaging apparatus. A specific advantage of such an apparatus in medical imaging is that the flux source can be addressed to emit radiation only in those areas where a radiation image is needed, thereby reducing the total amount of radiation directed at human or other imaging subjects.

A further advantage of the invention when used to produce X-ray flux is that it can increase the throughput of sterilization or decontamination processes.

BRIEF SUMMARY OF THE INVENTION

The invention disclosed herein provides a radiation source which can emit X-ray flux and other forms of radiation producible by an electron beam current. The substance of the invention is the formation of the cathode or cathode array which produces the electron beam current on the window through which the radiation will exit the source. The cathodes in the array have space between them so as to provide open area on the window. The radiation source disclosed herein can be made in formats which are compact or flat as compared with prior art radiation sources. It can be used to produce X-ray flux over wide areas for such purposes as radiation imaging, sterilization, decontamination of biohazards or photolithography.

DETAILED DESCRIPTION OF THE INVENTION

Although the following detailed description delineates specific attributes of the invention and describes specific designs and fabrication procedures, those skilled in the arts of microfabrication or radiation source production will realize that many variations and alterations in the fabrication details and the basic structures are possible without departing from the generality of the processes and structures. The most general attributes of the invention relate to the cathode array 100 formed on the exit window of the radiation source across from a metal X-ray target.

Figure 1A:
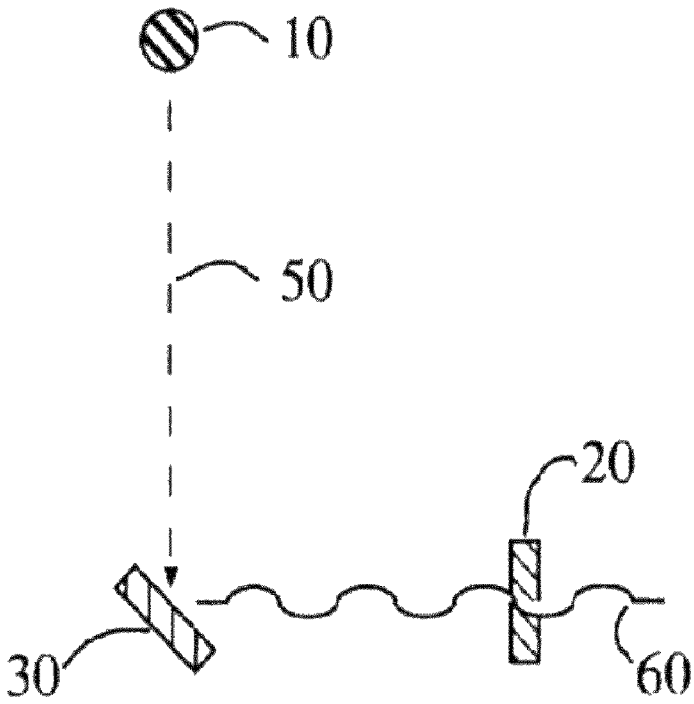
FIG. 1a (prior art)
FIG. 1*a* shows the general prior art concept of directing an electron beam current at an X-ray anode so as to produce X-rays at an angle to the current beam, the X-rays then exiting a window which is separate from the electron beam source.
Figure 2:
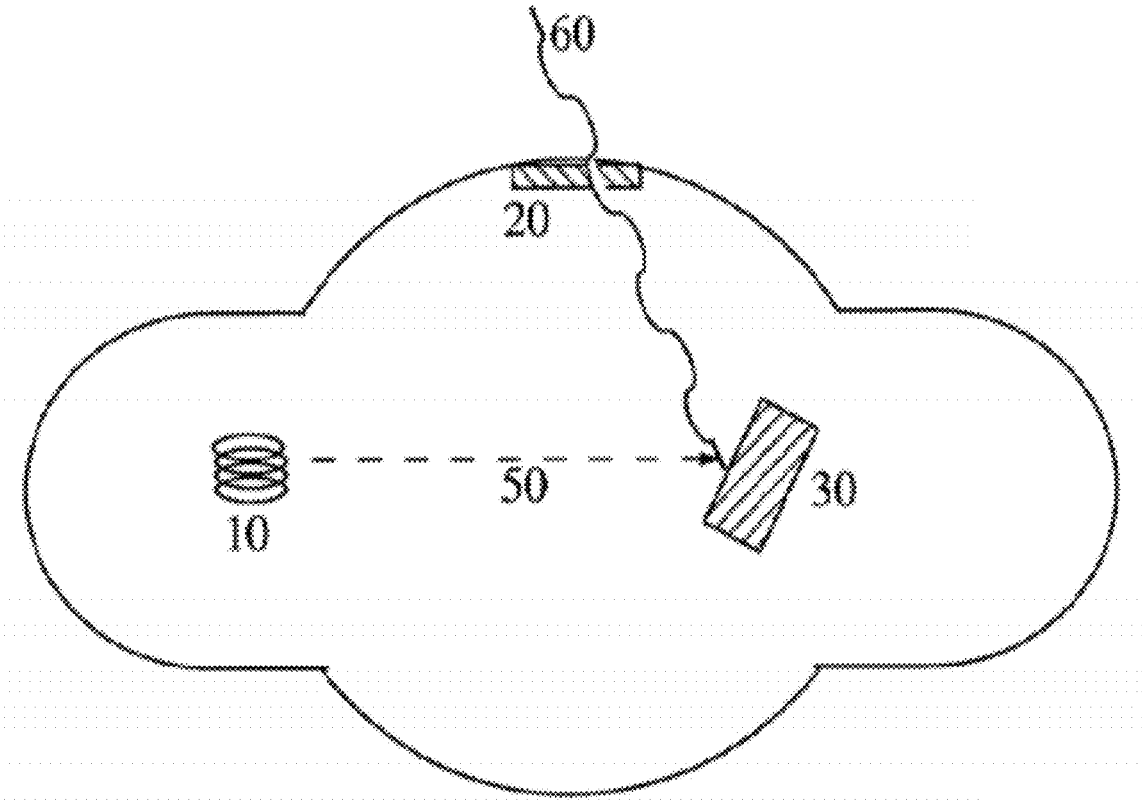
FIG. 2 (prior art)
FIG. 2 shows a prior art X-ray tube in which X-rays are produced in the manner depicted in FIG. 1*a*.

The general prior art method of producing X-ray flux is shown in FIG. 1*a* and FIG. 2. A cathode 10, commonly a hot filament cathode operated with an attached heater but more recently a field emission cold cathode, emits an electron beam current 50. An electrical potential established with respect to metal anode 30 directs this current at high velocity across a vacuum to impact the anode, which is disposed at an angle to the normal direction of the electron beam current. The impact of beam current 50 on metal anode 30 produces X-ray flux, comprising both characteristic line radiation and Bremsstrahlung radiation, which is emitted in all directions. A portion 60 of the X-ray flux is emitted in the direction of exit window 20 and passes through the window. Cathode 10 and anode target 30 are enclosed in a vacuum tube or envelope which is commonly made of glass or metal. X-ray flux which does not exit window 20 is absorbed in anode target 30, the vacuum envelope material, the exit window, or elsewhere in the source, this absorption process generating waste heat. Anode targets 30 have been made of many different elemental metals or alloys, the most common ones being tungsten, molybdenum, copper and tungsten-rhenium alloy. To reduce damage from electron beam impact and heating, anode 30 has been made as a disk with a beveled edge to provide a target angled in relation to beam current 50. This disk is connected to a metal rotor which is spun as part of an induction motor by a stator external to the vacuum tube or envelope. The electrical potential between cathode 10 and anode 30 varies widely depending on the desired energy of X-ray flux 60, higher potential producing higher energy X-rays. The higher the X-ray energy, the more ability the flux has to penetrate objects. Potentials used in imaging applications commonly vary between 30 keV and 200 keV. Depending on the material composition of anode target 30, different characteristic line energies, and amounts of characteristic line and Bremsstrahlung radiation, will be produced. Higher Z materials produce higher total amounts of radiation. The higher the electron beam current from cathode 10, the higher will be the X-ray flux generated at target 30 and therefore the X-ray flux 60 which exits the source. Exit windows 20 are commonly made of beryllium or other low Z materials with low coefficients of X-ray absorption, but they may be made of numerous other materials including various type of glass. In some prior art X-ray sources, the glass tube itself serves as the exit window. Numerous variations and combinations of these major elements of an X-ray source are well documented in the prior art.

Figure 1B:
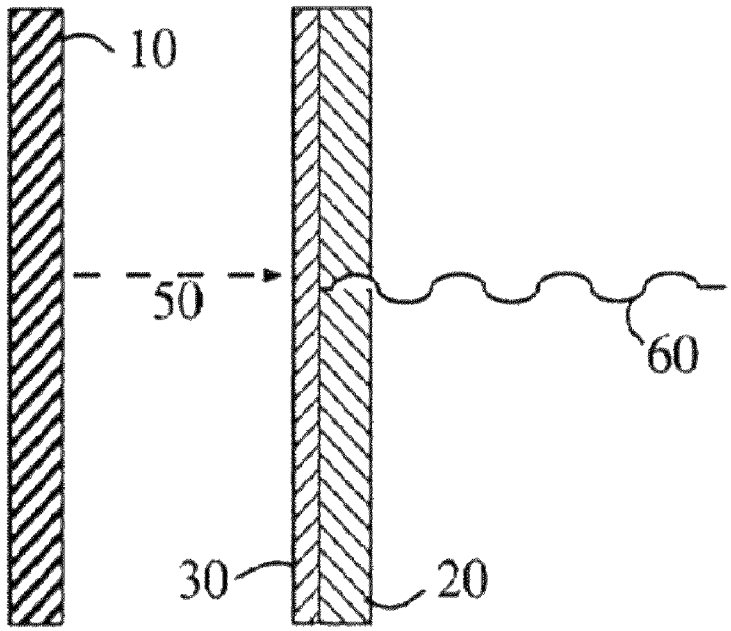
FIG. 1b (prior art)
FIG. 1*b* shows a prior art concept of directing an electron beam current at thin-film X-ray anode disposed on the exit window so as to produce X-rays which then exit the window in a direction opposite from the electron beam source.

A more recent prior art method shown in FIG. 1*b* disposes a thin anode target layer 30 on exit window 20. A wide source of electron beam current 50 is produced by a wide area cathode 10 which impacts broadly over anode target layer 30. X-ray flux is generated in all directions from the anode target layer, a portion of the flux passing through the thin target layer and then the exit window as X-ray flux 60. The thinner the anode target layer, the more X-ray flux can pass through, but the less ability this layer will have to transfer waste heat. Flux output from this type of X-ray source must be limited to avoid thermal stresses, especially mismatches between target layer film 30 and exit window 20, which can cause delamination of the film from the window.

Figure 1C:
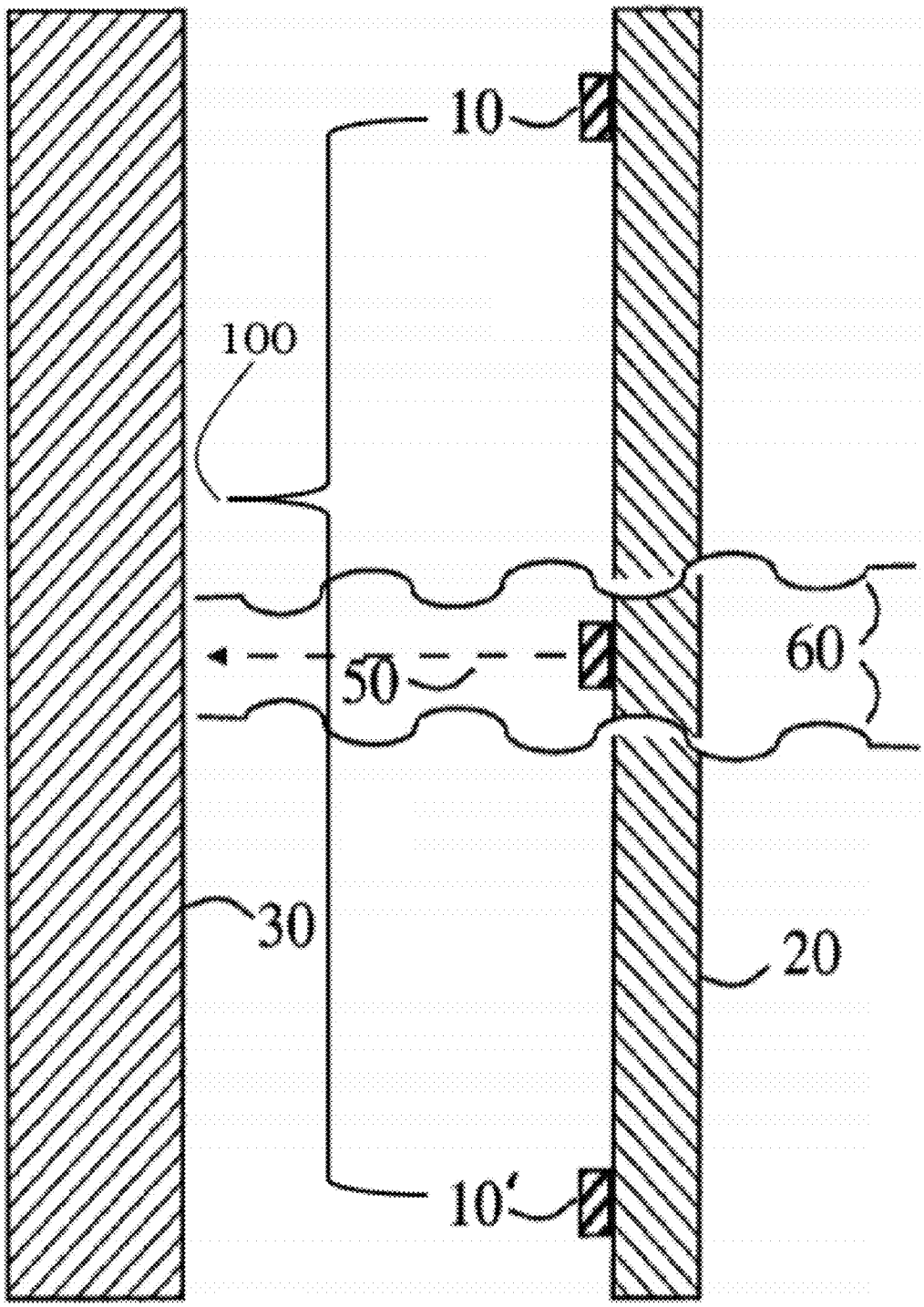
FIG. 1*c* shows the general concept as disclosed in this invention of directing an electron beam current from a thin film cathode array formed on an exit window at an X-ray anode so as to produce X-rays which then pass by the cathode array as they exit the window.
Figure 3:
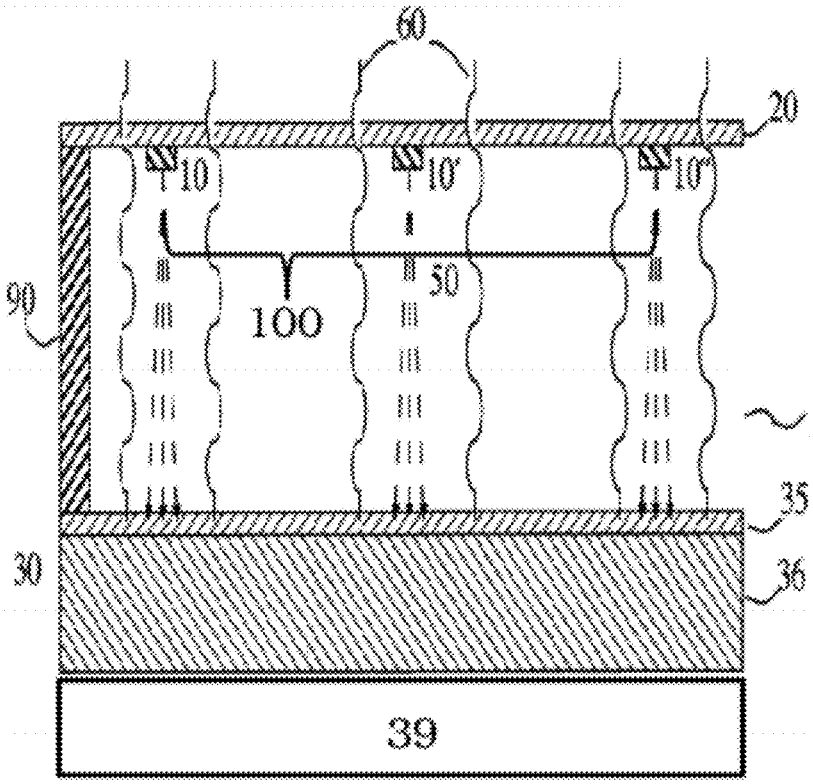
FIG. 3 shows a radiation source as disclosed in this invention in which an exit window with a thin-film cathode array is separated from a metal X-ray anode.

The invention disclosed herein uses a different approach and method for the generation of X-ray flux, shown conceptually in FIG. 1*c* and in one embodiment in FIG. 3. Cathode array 100 is formed on the exit window itself. Cathode array 100 may be an array of field emission cold cathodes. Beam current 50 is emitted from cathode array 100 to impact anode target 30, disposed opposite exit window 20. Anode target 30 may be a continuous sheet or slab of an X-ray target metal such as copper, tungsten or a tungsten-copper alloy. It may also be comprised of a film 35 of higher Z material, such as tungsten, attached to a sheet or slab 36 of material such as copper, chosen for lower cost, ease of working or superior heat dispersion characteristics. Film 35 may be bonded to sheet or slab 36 by sputtering or electroplating the material for film 35, by mechanically pressing film 35 on to sheet or slab 35 or by any other means which provides for the efficient conduction of heat from film 35 to sheet or slab 36. Film 35 may be a continuous thin film or it may be a film of discrete metallic particles. No matter how comprised, the other side of anode target 30 from cathode array 100 may be exposed directly to the outside atmosphere, in which case target 30 forms part of the vacuum envelope needed for operation of the radiation source. Further heat sinking structures 39 such as cooling fins, fans or forced liquid cooling channels may be provided on the atmosphere side of anode target 30 to allow operation of the source at very high power levels. Anode target 30 is made flat to provide a broad area source of X-ray flux. To produce X-ray flux from both sides of the source, target film 35 may be deposited on a sheet of material transmits a high degree of X-ray flux, though this embodiment will share some limitations of the prior art method shown in FIG. 1*b*.

Upon impacting anode target 30 in FIGS. 1*c* and 3, beam current 50 will generate X-ray flux in all directions. A portion 60 of this flux will be emitted in the direction of beam current 50 and out exit window 20. It is desirable to minimize the amount of X-ray flux absorbed by exit window 20 and cathode array 100 and the waste heat generated thereby. Exit window 20 may therefore be chosen of a material compatible with vacuum sealing that has a low Z number. Table 1 shows some of the available choices. The figures in the "X-ray Properties" columns were generated using the PENELOPE software code produced by Oak Ridge National Laboratories. Exit windows made of beryllium (Z=4) provide the highest fractional transmission of X-ray flux and have a high degree of mechanical strength, making them a good choice for a vacuum envelope, but they also have drawbacks due to the cost and toxicity of the material. Various plastics may also be used for the exit window, provided that they have high mechanical strength and do not outgas to such an extent as to lower the vacuum inside the envelope and increase the risk of arcing or other vacuum breakdown. Plastics may be mechanically reinforced and passivated on the vacuum side with, for example, thin layers of oxides so as to increase their compatibility with vacuum operation. Various forms of glass also have reasonably good X-ray transmission characteristics, are relatively inexpensive and are available in large sheets suitable for the formation of various types of wide cathode arrays. Sapphire is another viable choice for the exit windows.

TABLE 1

Exemplary Exit Window Choices

| Material | X-ray Properties: Absorption Coefficient (1/cm) | X-ray Properties: Fractional Transmission (%, 1 mm) | UV-C Properties: Transmission at 254 nm thru 1 mm | UV-C Properties: Stability | Mechanical Properties: Softening Point | Mechanical Properties: Deflection over 1 mm | Processing: Cost | Processing: Toxicity |
|---|---|---|---|---|---|---|---|---|
| Beryllium | 0.23 | 97.73% | 0 | high | high | low | high | very high |
| Polyethylene | 0.29 | 97.14% | ? | ? | low | high | low | low |
| Nylon | 0.45 | 95.60% | ? | ? | low | high | low | low |
| Lexan | 0.48 | 95.31% | ? | ? | low | high | low | low |
| Plexiglass | 0.54 | 94.74% | ? | ? | low | high | low | low |
| Graphite | 0.57 | 94.46% | 0 | high | high | low | med | low |
| Boron Carbide | 0.60 | 94.18% | 0 | high | high | low | high | low |
| Kapton | 0.61 | 94.08% | 0 | ? | low | high | med | low |
| Mylar | 0.65 | 93.71% | ? | ? | low | high | low | low |
| c-Boron Nitride | 0.80 | 92.31% | ? | high | high | low | high | low |
| Beryllium Oxide | 1.63 | 84.96% | ? | high | high | low | high | very high |
| Lithium Flouride | 2.06 | 81.38% | good | high | med-high | very high | high | ? |
| Pyrex | 4.83 | 61.69% | 70-80% | high | high | low | low | low |
| Magnesium Flouride | 4.98 | 60.77% | good | high | ? | med? | high | low |
| Vycor 7913 | | | 70-80% | high | high | low | low | low |
| Silion Dioxide, Quartz | 5.63 | 56.95% | >90% | high | high | low | med | low |
| Plate Glass | 8.11 | 44.44% | 0 | high | med | low-med | low | low |
| Aluminum Oxide | 8.45 | 42.96% | good | high | high | low | med | low |
| Aluminum | 9.10 | 40.25% | 0 | high | low-med | low-med | low | low |
| Lead Glass | 13.82 | 25.11% | 0 | high | low-med | low | low | med |

The absorption of X-ray flux by cathode array 100 can be minimized in two ways. First, the cathode array can be made of thin-film field emission cold cathodes. As shown in Table 1, cathodes made of graphite or other forms of carbon, which can be made in thicknesses of under a micron, will absorb very little of the X-ray flux. Second, the cathode array can be distributed over exit window 20 so as to occupy very little of the area of the exit window. An exemplary share of the cathode area to the total exit window area is under 10 percent.

FIG. 3 also shows a portion of side wall 90, an essential component of the vacuum envelope. Side wall 90 is preferably made of an insulating material such as glass, alumina or other insulating ceramics such as Macor™. Side wall 90, exit window 20 and anode target 30 may be formed and joined in many different formats to provide radiation sources suitable for a variety of purposes. Cylindrical tubes of insulating material may be joined to circular exit windows and anode targets to form the vacuum envelope. Tubes of glass or ceramic are commonly available with diameters ranging from under two centimeters to over twenty centimeters. The side walls may also be formed as rectangles by joining together strips of insulating material. Exit windows and anode targets made in corresponding rectangular formats are then joined to the top and bottom, respectively, of the side walls to form the vacuum envelope. Radiation sources thus constructed may be made very wide. A number of techniques are available from the flat panel display industry that can be used to form cathode arrays over wide sheets of glass. Rectangular glass sheets of up to two meters on a side are now used to produce displays. Sheets or slabs of anode target materials are available in similarly large sizes. It is thus possible to form radiation sources using the method of this invention with areas of several square meters or more.

The distance between cathode array 10 on exit window 20 and anode target 30 may be set according to the electrical potential used between cathode and anode. The distance should be sufficiently large to prevent arcing or other vacuum breakdown between cathode at anode at the chosen voltage. It should also be large enough to prevent external breakdown between conductive components such as feedthroughs on the external side of the source. An exemplary distance for a 100 keV potential is 2-5 centimeters. The exit window may be provided in thicknesses of under one millimeter to several millimeters, while the anode target sheet or slab can be provided with a thickness of several centimeters. The overall thickness of the source can thus be made from a few centimeters to perhaps ten centimeters. The ratio of the width of the source to its thickness can therefore be made greater than 3:1 and up to 100:1, for an essentially flat radiation source. The wider the area, the more need there will be for internal mechanical support to prevent deflection or sagging of the exit window 20 and anode target 30. Spacers of suitable insulating material such as ceramics may be used to provide such support. Internal walls may also be formed of glass or ceramic to provide such spacer support. In some embodiments of the invention, these internal walls can be arranged as a grid so as to allow the attachment of smaller exit windows in each grid opening, thereby creating a tiled exit window structure.

Side walls 90, exit window 20 and anode target 30 should be made and joined with materials having thermal coefficients of expansion (TCE) matched so as to prevent cracks in the vacuum envelope during X-ray production and consequent heat dissipation. An exemplary set of materials is a tungsten-copper alloy for the anode target, alumina for the side walls and sapphire for the exit window. The TCEs of these materials are very closely matched. They may be joined with frit glass sealing techniques common in the vacuum tube and flat panel display industries. Alternative sealing methods include O-ring seals of high-temperature materials such as Viton™ and mechanical clamping supports, vacuum-compatible epoxies or silica-based sealants. Non-evaporable getters may be affixed inside the radiation source disclosed in this invention so as to maintain vacuum throughout the operational lifetime of the source. Electrical and getter activation feedthroughs may be provided through side walls 90, exit window 20 or anode target 30. Anode target 30 may also have external electrical connection. Vacuum evacuation of the source may be accomplished through vacuum pumping through a pinch-off tube or valve attached to the source, or the assembly may be sealed in vacuum.

Operation of the X-ray flux source shown in FIG. 3 with cathode array 100 disposed directly opposite anode target 30 will improve the efficiency of X-ray generation and lower power requirements for a given level of X-ray flux 60 over prior art methods. Simulations run using the PENELOPE code show X-ray flux generation at various angles depending on the angle of incidence of electron beam 50. A zero degree angle of incidence means the electron beam impacts the anode target head on. The X-axis in the charts shows the dispersion of the X-ray flux, with 180° meaning the X-ray flux is emitted straight back at cathode array 100 and out exit window 20. It will be appreciated from the present disclosure that X-ray flux generation as provided in this invention is much more productive and efficient than prior art sources using angled anode targets.

Figure 4:
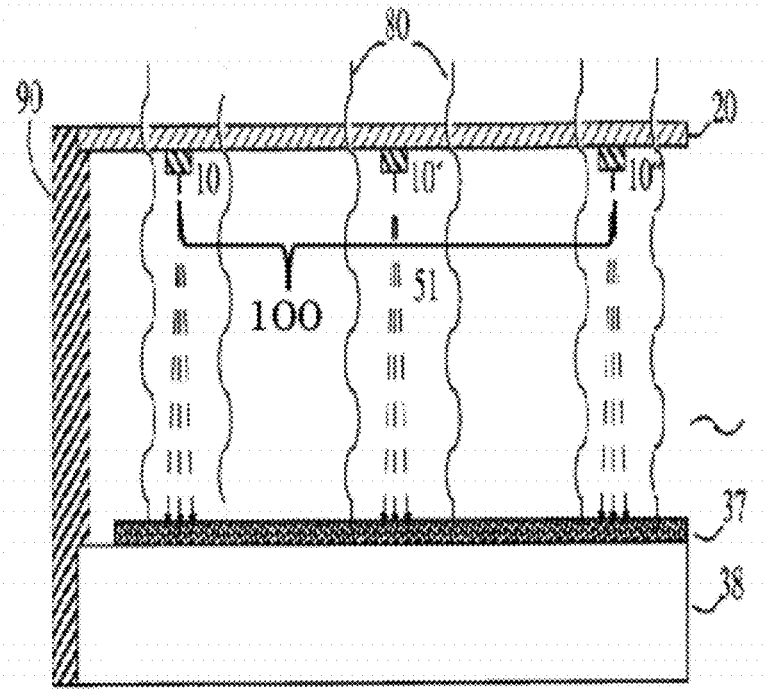
FIG. 4 shows a radiation source as disclosed in this invention in which the metal X-ray anode is covered with phosphors which emit UV-C radiation, the anode thereby emitting both X-rays and UV-C radiation simultaneously upon bombardment by the electron beam current from the cathode array formed on the exit window.

FIG. 4 shows a source for UV radiation, which can be made with similar techniques as the X-ray source disclosed in the foregoing. Cathode array 10 is formed on exit window 20 and emit electron beam current 51 towards phosphor layer 37 disposed on anode substrate 38. Phosphor layer 37 emits UV flux 80 in response to cathodoluminescent excitation back towards cathode array 100 and out exit window 20. Anode substrate 38 may be formed of a number of materials, including all materials for anode target 30 in the X-ray flux source shown in FIG. 3. It may also be made of glass, ceramic or other materials on to which a metallic anode layer can be formed. The UV flux source thus provided differs from prior art illumination sources in that flux is directed back toward the cathodes, rather than out through a glass substrate in the direction opposite the cathodes. The source shown in FIG. 4 may also be made to emit flux in both directions by using making substrate 38 out of glass and using a transparent material such as indium tin oxide as the metallic anode layer. The anode layer may be formed as lines and matrix addressed with respect to the cathodes to provide a pixelated source of UV flux. It will be appreciated that this radiation source can be used to produce flux at any wavelength for which phosphor materials are available, including UV-C wavelengths. The electrical potential between cathode array 100 and anode substrate 38 can range from a few hundred volts upwards to the voltages used in X-ray generation. The lower the voltage the more beam spread there will be from electron beam current 51 issuing from cathode source array 10. An exemplary voltage range for operation solely to produce UV-C flux is 500 V-30,000V. This radiation source may also be made in large, wide formats as described in foregoing description of the X-ray source disclosed in FIG. 3. Exit window 20 may be made of any material with a high degree of UV-C transmission and mechanical strength for holding vacuum. The various glasses and oxide materials shown in Table 1 are exemplary materials.

Phosphor layer 37 may be comprised of any of the conventional powder or nanopowder phosphors known in the art. Powder phosphors may be deposited on anode substrate 38 by settling with or without phosphor particle binders, by electrophoretic methods, screen printing, pressing, or by ink jet methods. Thin-film phosphors may also be used, in which case subsequent doping of the layer may be used to tune the spectral distribution of the flux. Scintillating ceramic phosphor layers are another exemplary material for phosphor layer 37. Powder laser phosphors may also be used, with beam current 51 operated to pump the laser materials.

Figure 5:
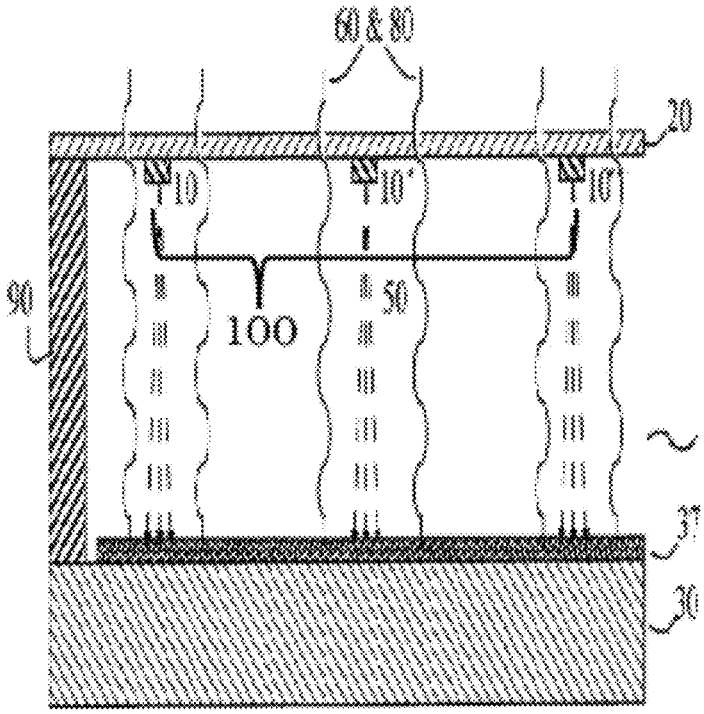
FIG. 5 shows a radiation source as disclosed in this invention in which a bottom anode plate is covered with a thin-film X-ray target, upon which phosphors which emit UV-C radiation are disposed, the anode thereby emitting both X-rays and UV-C radiation simultaneously upon bombardment by the electron beam current from the cathode array formed on the exit window.

FIG. 5 shows an exemplary combined source of X-ray and UV-C flux according to the invention. Phosphor layer 37 is disposed on X-ray target anode 30. Electron beam current 50 from cathode array 100 is emitted towards target anode 30. As electrons pass through phosphor layer 37 they excite the material to emit UV-C flux in all directions. After passing through phosphor layer 37 they impact anode target 30 to generate X-ray flux in all directions. A portion of the UV-C flux 80 and a portion of the X-ray flux 60 will be emitted back toward cathode array 100 and out exit window 20. Formation of anode target 30 with a material reflective of UV-C flux, or the provision of a thin reflective layer on anode target 30 will increase the amount of generated UV-C that is directed towards exit window 20 to nearly all of the UV-C flux generated, less a small amount absorbed internally in phosphor layer 37. UV-C flux can not pass through cathodes 10 opaque cathodes, so the preferred method of reducing blockage by the cathodes is to make them so as to occupy as small an area on exit window 20 as possible. It is also possible to use roentgoluminescent materials as or as part of phosphor layer 37, in which case the X-ray flux produced at anode target 30 will stimulate the emission of UV-C flux. This radiation source may also be made in large, wide formats as described in foregoing description of the X-ray source disclosed in FIG. 3. In this embodiment of the invention, the exit window should be chosen for high transmission of both X-ray and UV-C flux. Quartz, Vycor™, Pyrex™ and sapphire are exemplary materials choices, as is shown in Table 1.

Figure 6:
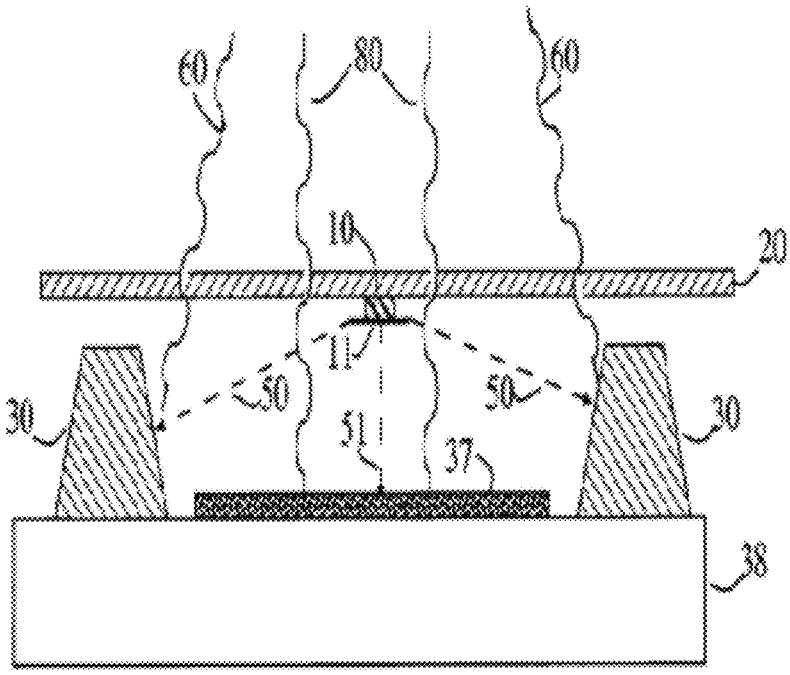
FIG. 6 shows a radiation source as disclosed in this invention in which X-ray target structures are formed on a bottom plate and UV-C phosphors are disposed on the bottom plate between the X-ray target structures, so as to allow excitation of the X-ray and UV-C targets at different voltages with respect to the thin-film cathode array, both fluxes exiting the window on which that array is formed.

There are many possible configurations of X-ray or combined flux sources in keeping with the method and scope of the invention, another example being shown in FIG. 6. In this embodiment, both X-ray anode targets 30 and UV-C phosphors 37 are disposed on substrate 38. X-ray targets 30 may be metal bumps or ridges ranging in height from 10 to 200 microns and formed of copper, tungsten, or tungsten-plated copper. UV-C phosphors may be deposited on a reflective anode lines formed on substrate 38. Substrate 38 may be an insulator such as glass or it may be a metal sheet or slab such as copper. If it is conductive, it is preferable to form an insulating layer under the anode line for phosphor layer 37. A common cathode array 100 can alternately be used to emit electron beams beam currents 50 and 51 at the X-ray and UV-C targets, respectively. The potentials for operation of these beam currents can be set higher for beam 50 directed at the X-ray target and lower for beam 51 directed at the UV-C phosphors. Alternatively, separate cathodes can be used for the two beam currents. FIG. 6 shows a thin-film cold cathode edge emitter 11, made as part of a cathode array on a radiation exit window, which emits current approximately normal to the facing surface of X-ray anode target 30, thereby maximizing the efficiency of X-ray flux generation. The X-ray and UV-C fluxes thus generated both exit the same window 20.

A variety of cathodes can be used in the cathode array for the radiation source according to the invention. Thin-film hot filament cathodes can be used, with internal or external heaters. The preferred cathodes, however, are thin-film, field-emission cold cathodes. The wide variety of cold cathodes known in the art can be used in this invention, including metal or semiconductor tip arrays, flat cathodes of low-work-function materials, metal-insulator-metal cathodes, surface conduction emission cathodes, vertical or horizontal arrays of carbon nanotubes, or field emitters with conductive chunks embedded in an insulating medium. A preferred cold cathode is the thin-film edge emitter 11 shown in FIG. 7. In these cathodes, field emission is from the external edges of a conductive thin film, which can be made of metal, various forms of carbon, or a carbon layer with upper and lower metal cladding layers to enhance conduction. Thin-film edge emitters made of arc-deposited carbon, pulsed arc deposited carbon, plasma arc deposited carbon, CVD diamond, laser ablated carbon or filtered arc deposited carbon are all suitable for use as cathodes in the invention. These cathodes can be made as continuous strips, as broken segments connected by conductive metal, or as separate cathode structures. Thin-film carbon cold cathodes are very thin, ranging in thickness from under a hundred Angstroms to a few thousand Angstroms. Metal conductive cladding can add several hundred more Angstroms to this thickness, but the resulting structure will still be so thin as to allow the transmission of essentially all the X-ray flux that reaches the cathodes. The cathodes are formed as arrays. In an exemplary design with an exit window of 100 $cm^2$, an array of 10,000 cathodes, each occupying about 2,500 $\mu m^2$, can supply all the current needed for the operation of a 500 Watt X-ray source at 100 keV.

Figure 7:
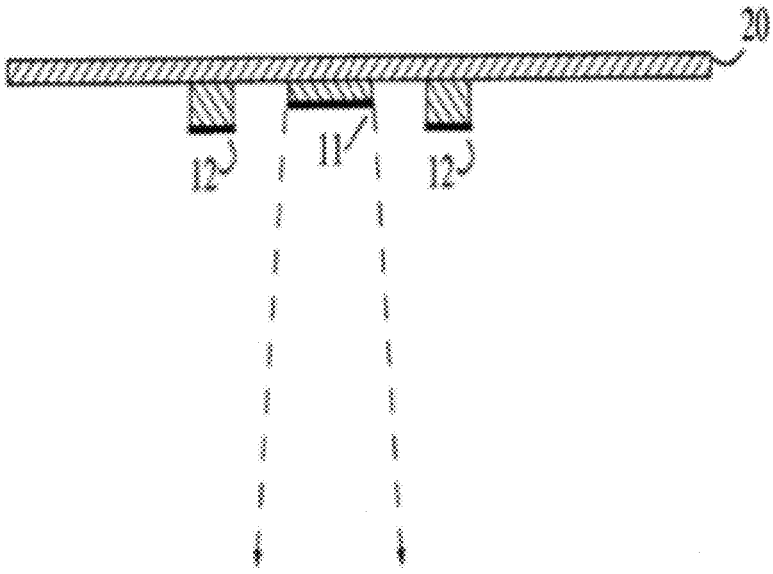
FIG. 7 shows detail of a thin-film field emission cathode and gate structure which can be formed on an exit window.
Figure 8:
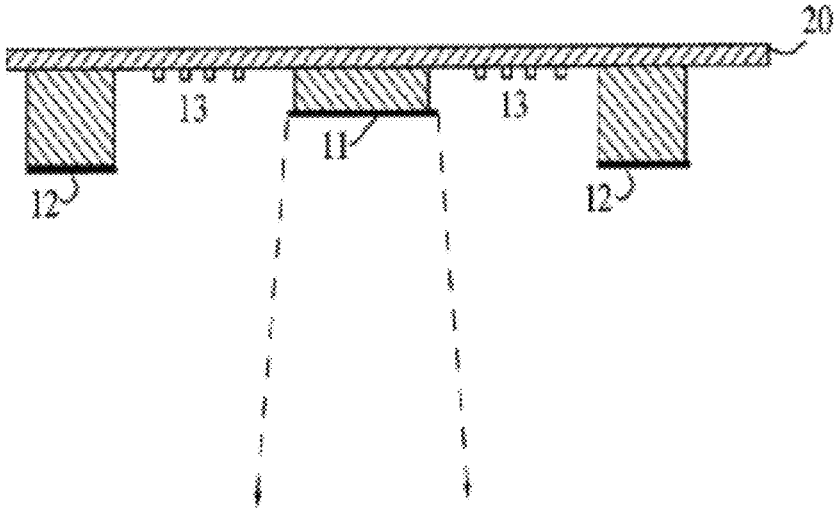
FIG. 8 shows detail of a structure which can block shorts between the thin-film field emission cathode and gate structure shown in FIG. 7.

The cathodes can also be gated so as to provide greater current control than would be possible in diode operation and radiation source control at lower voltages. Several gating schemes can be used. Separate transistors, such as field effect transistors, can be connected to individual cathodes or groups of cathodes. A preferred method is to use an extraction gate 12 placed close to the cathode, such as is shown in FIG. 7. In this embodiment, a gate voltage between 20 and 2,000V can be used to extract current from thin-film edge emitter cathode 11, the current then being captured by the field established by a higher voltage between cathode and anode. In operation, field emitters can sometimes emit debris due to microdischarges from the cathode or gate, or electromigration of material. It can therefore be advantageous to provide barriers to these material discharges so as to prevent cathode to gate shorts. These barriers, shown as lines of small ridges 13 in FIG. 8, can be made of deposited material or etched into exit window 20. Small pads for the cathodes and gates can also be made by depositing material or etching material from the window. These pads provide clearance for field lines between cathode and gate. They also allow the height of the gate to be raised in relation to the height of the cathode, which in turn provides control of the angle at which the electron beam current is emitted from the cathodes.

Figure 9:
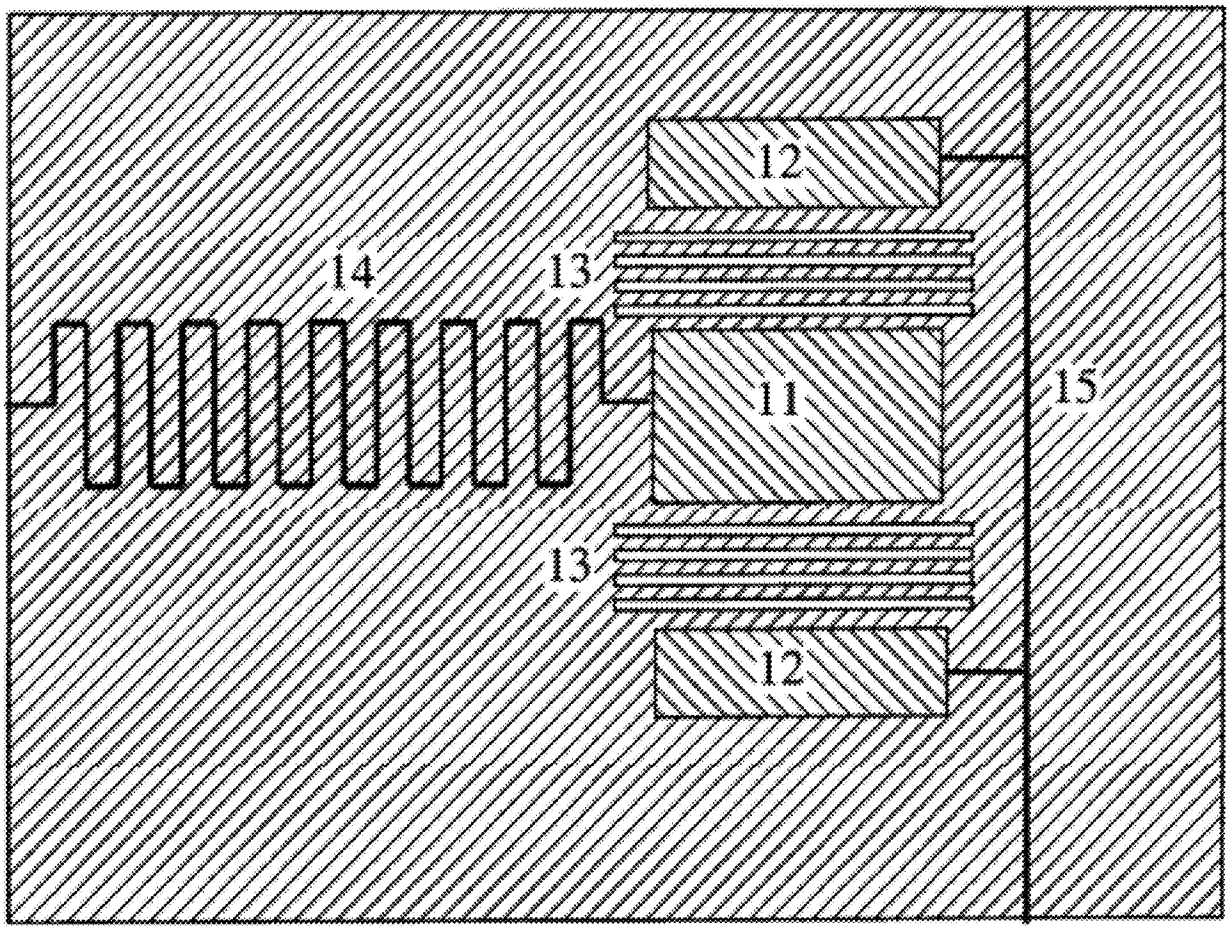
FIG. 9 shows a resistor layout for the thin-film cathode of FIG. 7.

In a high voltage system such as the radiation source according to the present invention, it can be advantageous use a resistor to improve emission uniformity across a cathode array, suppress emitter to extractor arcs, and to act as current limiters for any emitter to extractor shorts. FIG. 9 shows one resistor layout for the cathodes used in the radiation source of the present invention, in which a thin-film meander line 14 of a resistive material, such as arc-deposited graphite, is connected from a power bus line to cathode 11. The line width, length and thickness can be varied to provide appropriate resistive values for cathodes operating under different conditions.

FIG. 9 also shows a top view of an entire cathode layout, including cathode 11, gate 12, debris catching ridges 13, resistor line 14 and gate bus line 15. Cathodes and gates in this configuration can be matrix addressed so as to provide small radiative emission spots, or pixels, from corresponding X-ray or UV-C targets across from the cathodes. Individual cathodes can be addressed so as to provide single spots or groups of cathodes can be addressed to provide emission patterns. This ability to precisely control radiative flux profiles over wide areas is useful for a number of imaging and scientific applications.

Separate or combined sources of X-ray made according to the invention may be used to sterilize materials or to decontaminate biological or chemical hazards. In decontamination applications, these radiation sources may be combined into systems with the individual sources positioned so as to allow the broadest and most effective coverage of a contaminated area. In an office environment. For example, the sources may be arranged at three levels, each having three or more sources to provide 360° coverage of the area. One tier may be at ankle height so the flux can reach contaminants under tables or desks and on the floor. The next tier may be at waist height so the flux can reach contaminants which have settled on desks or tables, while the third tier may be at shoulder height so the flux can reach contaminants which have settled on cabinets and other tall objects. The sources may also be rotated to provide 360 degree. coverage or mounted on robots with radiation shielded electronics and moved around the contaminated space.

The present invention is well adapted to carry out the objects and attain the ends and advantages described as well as others inherent therein. While the present embodiments of the invention have been given for the purpose of disclosure numerous changes or alterations in the details of construction and steps of the method will be apparent to those skilled in the art and which are encompassed within the spirit and scope of the invention. The cathodes of the source, for example, may be mounted on pillars formed on the target or target substrate with the exit window attached to these pillars.

What we claim is:

1. An apparatus for producing X-ray flux comprising:

a cathode array, said cathode array comprising at least two electrically separated cathodes formed on a flat flux exit window, said flat flux exit window being an electrically non-conductive substrate, where each of said cathodes comprises at least two electron emitters;

wherein each of said at least two electrically separated cathodes are individually attached via a separate resister line to an address or bus line;

wherein said cathode array emits multiple electron beam currents toward a flat X-ray target, thereby causing said flat X-ray target to emit X-ray flux, a portion of which is emitted through said flat flux exit window, a vacuum enclosure, wherein said flat flux exit window and said flat X-ray target are two sides of said vacuum enclosure such that one major surface of said flat flux exit window and one major surface of said flat X-ray target are not subject to the vacuum of the said vacuum enclosure and the other major surface of said flat flux exit window and the other major surface of said flat X-ray target are subject to the vacuum of said vacuum enclosure.

2. The apparatus of claim 1, wherein the electrically separated cathodes comprise gated field emission cold cathodes.

3. The apparatus of claim 1, wherein the electrically separated cathodes comprise carbon cold cathodes.

4. The apparatus of claim 1, wherein the electrically separated cathodes comprise carbon cold cathode edge emitters.

5. The apparatus of claim 1, wherein the cathode array comprises a plurality of thermionic cathode wires.

6. The apparatus of claim 1, wherein the electrically separated cathodes are operable to generate x-ray flux from small spots on said flat x-ray target.

7. The apparatus of claim 1, further comprising a forced air or liquid cooling system, wherein the other major surface of said X-ray target is coupled to said forced air or liquid cooling system.

8. A flat panel X-ray source comprising:

a cathode array formed on a flat, electrically non-conductive X-ray flux exit window, said cathode array comprising a plurality of individual cathodes, each individual cathode being comprised of at least one electron emitter, and said plurality of cathodes being discontinuously formed in said cathode array, such that there is electrically non-conductive space on said exit window between individual ones of said plurality of individual cathodes and wherein each of said individual cathodes is individually attached via a separate resister line to an address or bus line; and a vacuum enclosure, comprising a metallic X-ray target disposed opposite said cathode array, said metallic X-ray target comprising a first surface facing said cathode array and exposed to an internal vacuum pressure maintained by said vacuum enclosure and a second surface exposed to the exterior atmosphere;

said flat, electrically non-conductive X-ray flux exit window and said metallic X-ray target forming two walls of said vacuum enclosure; and wherein said cathode array may operate to emit multiple electron beams towards said metallic X-ray target to generate X-ray flux, at least a portion of said X-ray flux emitting out said exit window.

9. The structure of claim 8, wherein the individual cathodes comprise gated field emission cold cathodes.

10. The structure of claim 8, wherein the individual cathodes comprise carbon cold cathodes.

11. The structure of claim 8, wherein the individual cathodes comprise carbon cold cathode edge emitters.

12. The structure of claim 8, wherein the cathode array comprises a plurality of thermionic cathode wires.

13. The structure of claim 8, wherein the individual cathodes are configured for generating flux from small spots on said metallic X-ray target.

14. The structure of claim 8, further comprising a forced air or liquid cooling system, wherein the second surface of said metallic X-ray target is coupled to said forced air or liquid cooling system.

15. A structure for producing radiative flux comprising:

a cathode array, comprising an array of individual cathodes with open space between individual cathodes in the array;

a vacuum enclosure, comprising vacuum boundaries that further comprise an x-ray target and an exit window, the cathode array formed on the exit window of the vacuum enclosure, the cathode array operable to emit an electron beam current away from the exit window;

wherein the cathode array is operable to emit the electron beam current towards the x-ray target; the electron beam current thereby causing the x-ray target to emit x-rays, a portion of which will be emitted in the direction of the cathode array and pass through the cathode array and through the exit window; and a UV-C phosphor layer provided on the surface of said x-ray target operable to emit UV-C flux.

16. The structure of claim 15 wherein the radiative flux target is a powder laser phosphor and the electron beam current of the cathode array is used for laser pumping.

* * * * *